United States Patent [19]

Bisaillon et al.

[11] 4,067,217

[45] Jan. 10, 1978

[54] APPARATUS FOR FORMING A WHEEL RIM

[76] Inventors: Gerard Bisaillon; Gilles Bisaillon, both of Chemin Couture, Magog, Canada

[21] Appl. No.: 776,707

[22] Filed: Mar. 11, 1977

[30] Foreign Application Priority Data

Nov. 2, 1976 Canada ..... 264651

[51] Int. Cl.[2] ..... B21H 1/10

[52] U.S. Cl. ..... 72/91; 72/105; 29/159.1

[58] Field of Search ..... 72/82, 91, 105, 106, 72/110; 29/159.1; 113/116 D, 116 E

[56] References Cited

U.S. PATENT DOCUMENTS 1,939,577 12/1933 Sneed ..... 72/105

FOREIGN PATENT DOCUMENTS 590,667 1/1960 Canada ..... 29/159.1

*Primary Examiner*—Lowell A. Larson

*Attorney, Agent, or Firm*—Emory L. Groff, Jr.

[57] ABSTRACT

A wheel rim is formed from a cylindrical blank in an apparatus including a female die with a profiled, internal die cavity for receiving the blank and a male die, which includes a pair of shafts with eccentric portions carrying rollers for sequentially bearing against the blank to gradually form a wheel rim. During formation of the wheel rim, the female die, which is mounted on a turntable, is rotated while the male die is stationary. The blank is held between a ring portion of the male die and the central portion of the female die. The shafts carrying the rollers are independently rotatable, so that only one set of rollers actively forms the rim at any time during formation.

10 Claims, 14 Drawing Figures

APPARATUS FOR FORMING A WHEEL RIM

BACKGROUND OF THE INVENTION

1. Field of the Invention

This invention relates to an apparatus for forming a wheel rim, and in particular to an apparatus for producing a wheel rim from a cylindrical blank.

2. Description of the Prior Art

Vehicle wheel rims are conventionally manufactured from sheet metal blanks, which may be cold rolled to impart the desired profile to the blanks, cut to the required length, soldered to connect the ends of the blanks and finally placed in a so-called expander to give the rims their final dimensions. Such a method of producing wheel rims is relatively expensive and complicated, requiring two or more large machines for forming and closing the blanks, and for imparting the desired final configuration and dimensions to the rims.

Alternatively, the rims are formed from cylindrical blanks using a machine including an annular die having an internal profile identical to the desired final profile of the rims, and a turntable rotatable in the annular die. Such a machine is disclosed by U.S. Pat. No. 2,933,124 which issued to W. E. Benson and G. E. Benson on Apr. 19, 1960. The turntable includes a pair of profiled primary rollers which are radially displaceable for pressing against a cylindrical blank to deform the latter agaisnt the interior surface of the female die. With the male die rotating, the primary rollers are moved outwardly simultaneously by a spreader roller, which is operated by a hydraulic cylinder or by a rack and pinion arrangement to impart the basic rim configuration to the blank. The rim is completed, i.e. the rim beads are formed by means of eccentric discs, eccentrics or separate flange formation rollers.

When forming conventional wheel rims, a machine of the type disclosed by the above-identified United States patent is preferred. However, it is unlikely that the Benson machine in its simplest form whould be capable of accurately forming wheel rims from thick blanks, e.g. ¼ inch steel blanks used for truck wheel rims. The forces involved in the formation of such a rim are considerable, and the simultaneous movement of a pair of rollers against the blank to form a rim would be difficult if not impossible. Moreover, most forms of the Benson machine are relatively complicated, and consequently expensive to produce. For example, the Benson patent proposes the use of a multi-part annular female die.

Even more important is the fact that, in all forms of the Benson machine, the blank is suspended in the annular die between a central well formation projection on the die and the top and bottom edges of well formation rollers on the turntable. No provision is made for accurately positioning the blank in the annular die. With the Benson arrangment, it is quite likely that the blank would be drawn into the annular central recesses of the rollers unevenly. Moreover, applicants believe that it is quite likely that the blank is stretched during formation in the Benson machine, resulting in a rim of non-uniform thickness. Finally, with the Benson machine, a blank of intermediate diameter is used, i.e. a blank having a diameter between the maximum and minimum diameters of the rim. Thus, the blank must be deformed along its entire length; inwardly at the centre to form the well and outwardly at the top and bottom ends to form the tire beads. The result is a relatively complicated forming process, with accompanying risk of improper rim formation.

Thus, in its simplest form, the Benson machine is at best difficult to operate and in its more sophisticated forms is complicated and expensive to produce.

The Benson patent strongly suggests (column 2, lines 19 to 41) that the use of a rotatable female die is impractical. Applicants have found that such is not the case, and that a relatively simple and inexpensive apparatus for forming a wheel rim from a cylindrical blank can be produced using a rotatable female die and a stationary male die. The present invention relies on the use of separate profiled rollers for deforming a blank stepwise, the rollers being mounted on eccentric shafts which are rotated one at a time to bring selected rollers to bear against the rim sequentially.

SUMMARY OF THE INVENTION

Specifically, the apparatus of the present invention includes a rotatable turntable; a female die mounted on the turntable for rotation therewith, the female die having a profiled cavity for receiving a cylindrical blank; a cylindrical male die including at least two separate roller shafts, and rollers mounted on each roller shaft and rotatable relative to said shaft; means for inserting the male die into the female die cavity; and means for moving each roller shaft individually towards and away from the rotating blank and female die, whereby the blank can be deformed sequentially to form a wheel rim.

In the preferred form of the invention, the cylindrical male die includes a ring for bearing against and rotating with the blank and female die, and a pair of eccentric roller shafts. The ring is loosely contained in a groove in the periphery of the male die, and, in use cooperates with he smallest diameter centre portion of the female die to lock the blank in forming position. Each eccentric roller shaft includes a pair of built up portions or projections on one side thereof. The rollers are mounted for rotation on the projections. When not in use, the rollers are completely within the body of the male die. By rotating the shafts approximately 180° around their longitudinal axis, the rollers are moved out of the body of the male die from the rest position completely within the male die to a final working position where the rollers bear against the blank in rim form.

The diameter of the blank employed in the above defined apparatus is equal to the minumum diameter of the finished rim, i.e. the well diameter. The length of the blank is greater than the length of the finished rim by an amount sufficient to allow for blank deformation without a reduction in thickness. For example, in the production of a truck wheel rim using a ¼ inch thick blank, the cylindrical blank is 12 inches long, and the finished rim is 10 ½ inches long. The central portion of the blank, sandwiched between the ring of the male die and the smallest diameter portion of the female die, is not deformed during formation of the rim. Thus, each end of the blank is drawn towards the centre of the female die during formation of a rim, the thickness of the blank remaining constant throughout a working operation.

It has been found that the dimensions of the blank produced in the apparatus described above are well within acceptable limits, very little heat is generated during formation, and the rims are formed relatively quickly, i.e. in a matter of a few minutes from the time a blank is placed in the female die.

DESCRIPTION OF THE PREFERRED EMBODIMENT

Figure 1:
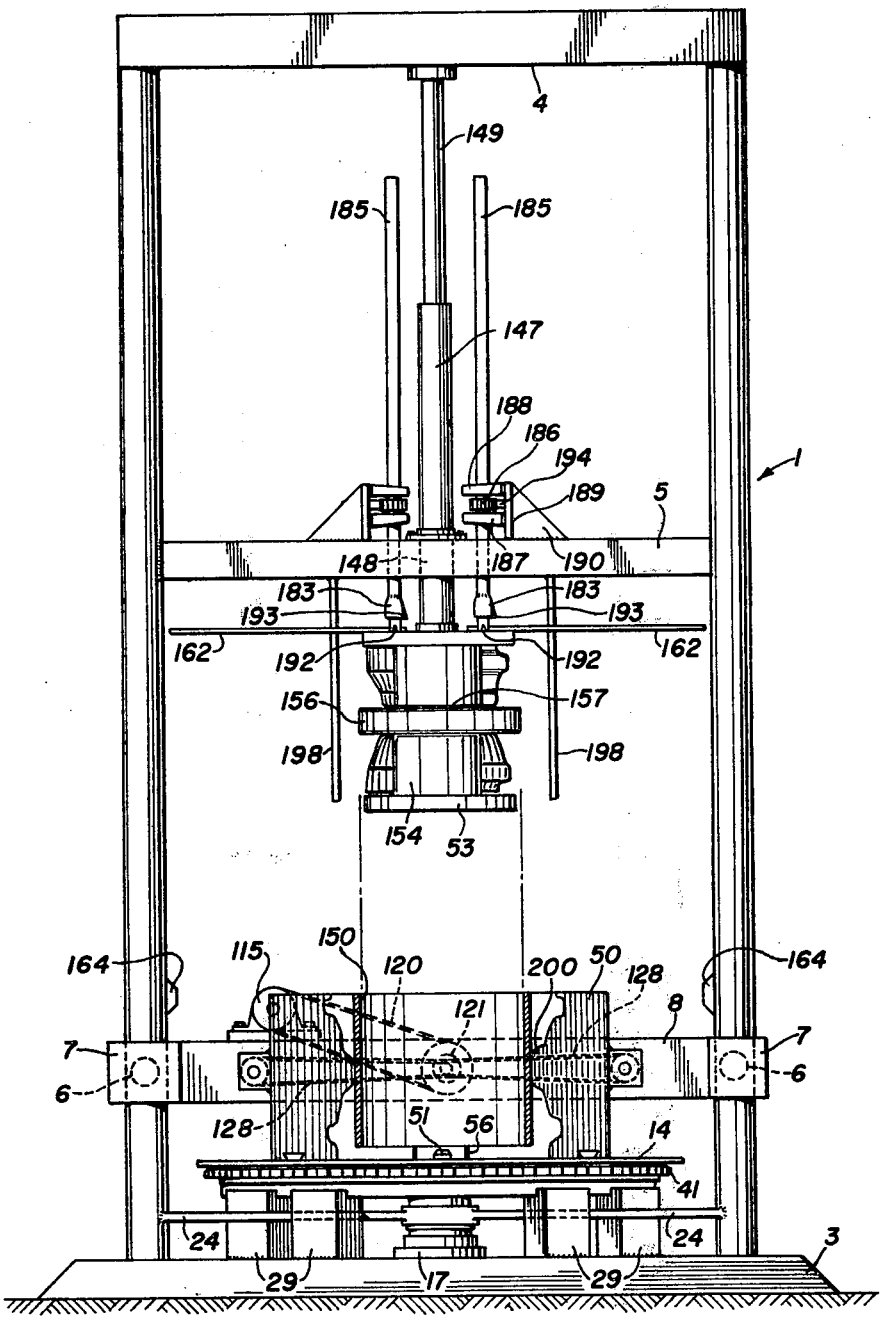
FIG. 1 is a partly sectioned front view of an apparatus in accordance with the present invention.
Figure 2:
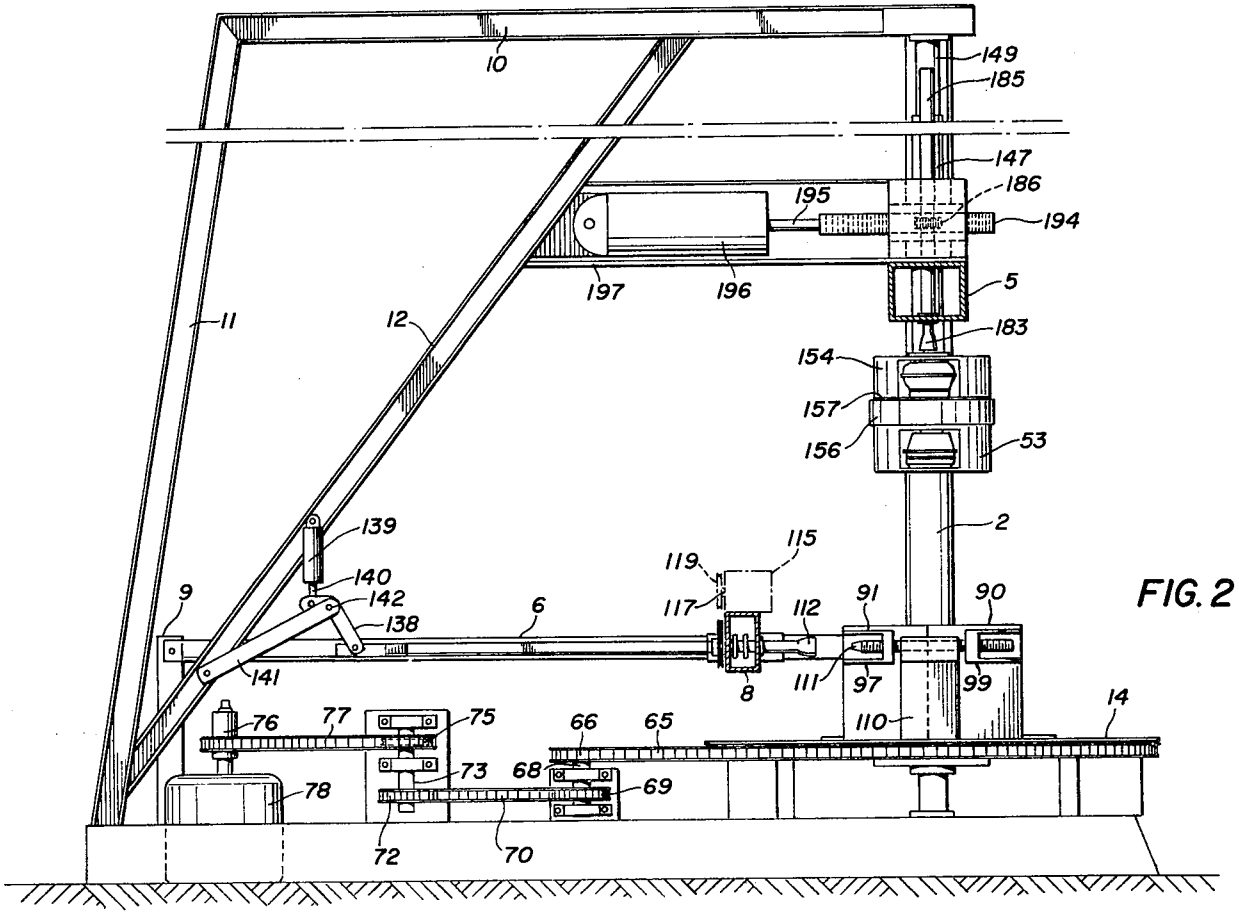
FIG. 2 is a schematic, partly sectioned elevation view of the apparatus of FIG. 1.
Figure 3:
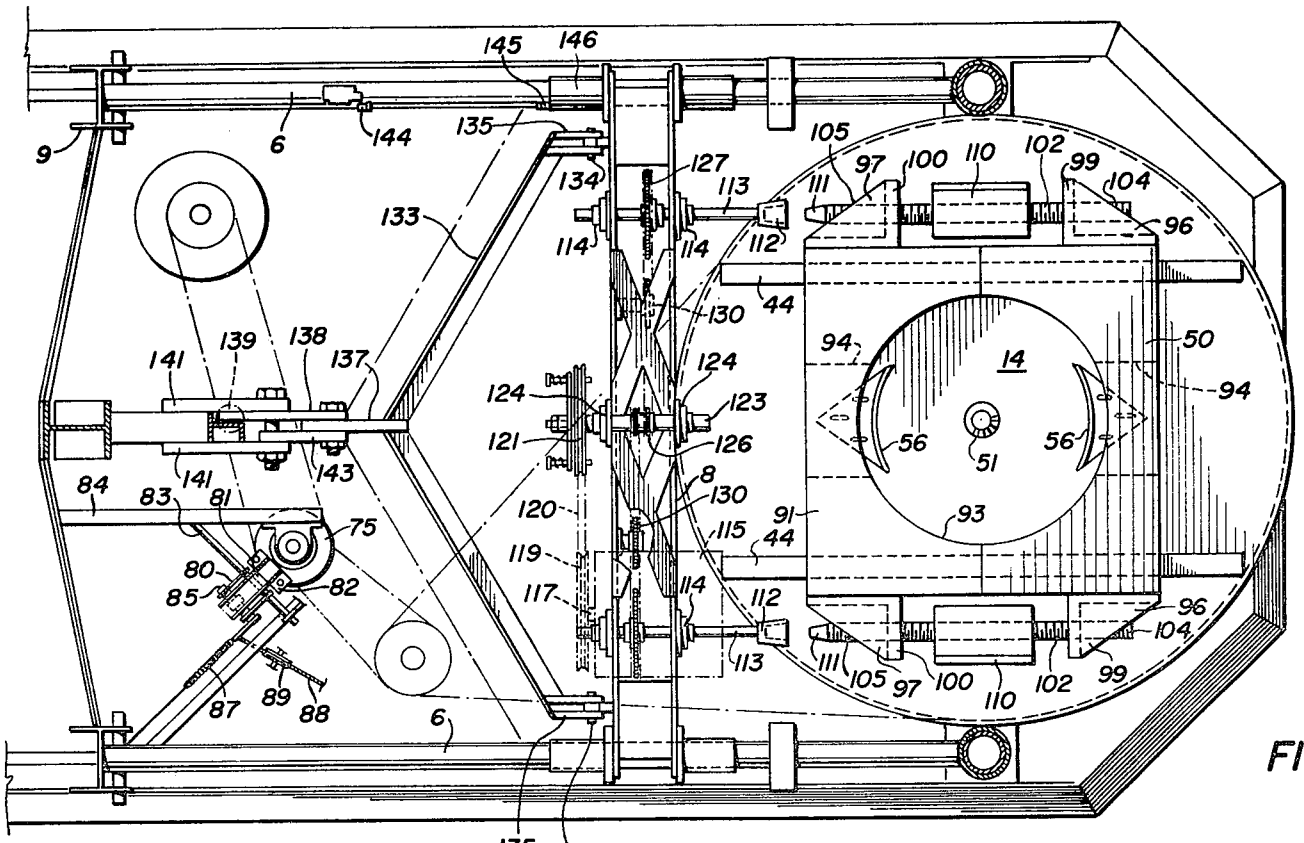
FIG. 3 is a partly sectioned plan view of the apparatus of FIGS. 1 and 2.

With reference to the drawings and in particular to FIGS. 1 to 3, the preferred form of the apparatus of the present invention includes a frame generally indicated at 1 having a rectangular front portion formed by a pair of columns 2 interconnecting a generally rectangular base 3 and a top beam 4. A cross-bar 5 extends between the colums 2 near the top of the frame for reinforcing the frame and for supporting various elements of the apparatus, as described in greater detail hereinafter. A cylindrical track 6 (FIGS. 2 and 3) extends rearwardly from a sleeve 7 on each of the columns 2 for slidably supporting a rectangular carriage 8. The rear end of each track 6 is supported by a post 9. The frame is completed by a horizontal beam 10 extending rearwardly from the top beam 4, an inclined rear beam 11 extending downwardly from the horizontal beam 10 and an inclined reinforcing beam 12 extending between the centre of the horizontal beam 10 and the bottom of the inclined beam 11.

Figure 4:
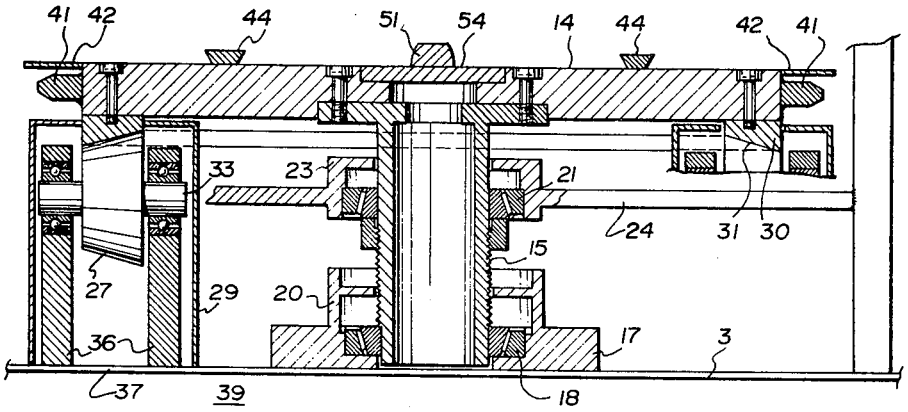
FIG. 4 is a cross-sectional view of a turntable used in the apparatus of FIGS. 1 to 3.

Referring specifically to FIG. 4, the rectangular base 3 supports a circular turntable 14, which includes a central shaft 15 extending downwardly to a plate 17. Bearings 18 are provided between the bottom of the shaft 15 and the plate 17, whereby the turntable 14 can be rotated about the vertical axis of the shaft 15. A well 20 extends upwardly from the plate 17 around the shaft 15 for holding lubricant. A second set of bearings 21 rotatably support the shaft 15 near its top end. The bearings 21 are mounted in a sleeve 23 supported by arms 24, which extend transversely to the columns 2. The arms 24 are welded to the columns 2, thus ensuring proper support of the shaft 15 and the turntable 14. The bearings 21 are held in the sleeve 23 by a nut 26 mounted on the threaded bottom portion of the shaft 15. The outer edge of the turntable 14 is supported by frusto-conical rollers 27 mounted in five spaced apart bearing boxes 29 near the periphery of the turntable 14. The rollers 27 taper outwardly for supporting a circular track 30 on the bottom surface of the turntable 14. The bottom edge 31 of the track 30 slopes radially outwardly for mating with the rollers 27, ensuring that the track and turntable do not become disengaged from the rollers 27. Each of the rollers 27 is mounted on a shaft 33 supported at each end by ball bearings 34 in posts 36 in the bearing box 29. The bearing box 29 is provided with an aperture 37 in its bottom end in fluid communication with an oil reservoir 39 in the base 3 of the frame. The boxes 29 and reservoir 39 are filled with oil so that the rollers 27 are constantly lubricated.

Teeth 41 are welded to the peripheral side edge of the turntable 14 for connecting the turntable to drive elements to be described hereinafter, and an annular flange 42 on the side edge of the turntable covers the teeth. A pair of trapezoidal, downwardly tapering tracks 44 are provided on the top surface of the turntable 14 for supporting a female die 50. A frusto-conical post 51 for centering a male die 53 is located on a circular plate 54 in the top centre of the turntable 14.

A pair of blank positioners 56 are also provided centrally on the turntable 14 between the tracks 44. Each blank positioner 56 includes a triangular plate 57 with elongated slots 59, through which pins 60 project from the turntable 14, and an arcuate vertical flange 62 along the inner edge of the plate 57. The flange 62 has the same radius of curvature as the blank, and, when the positioners 56 are at their innermost locations, the flanges 62 define part of a circle of the same diameter as the blank.

Figure 5:
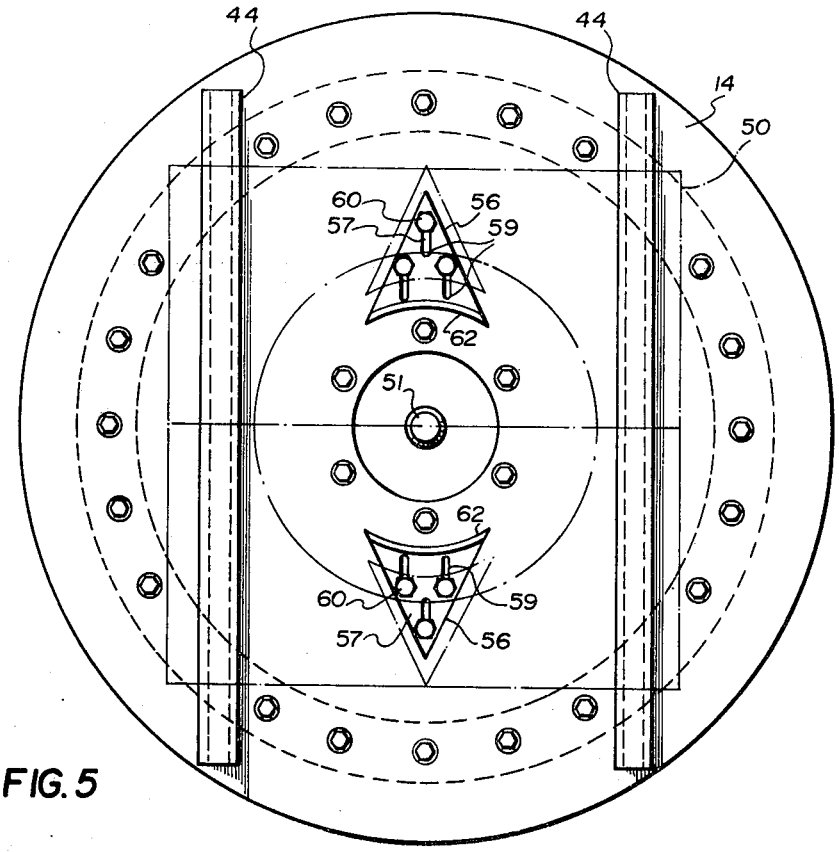
FIG. 5 is a plan view of the turntable of FIG. 4.
Figure 6:
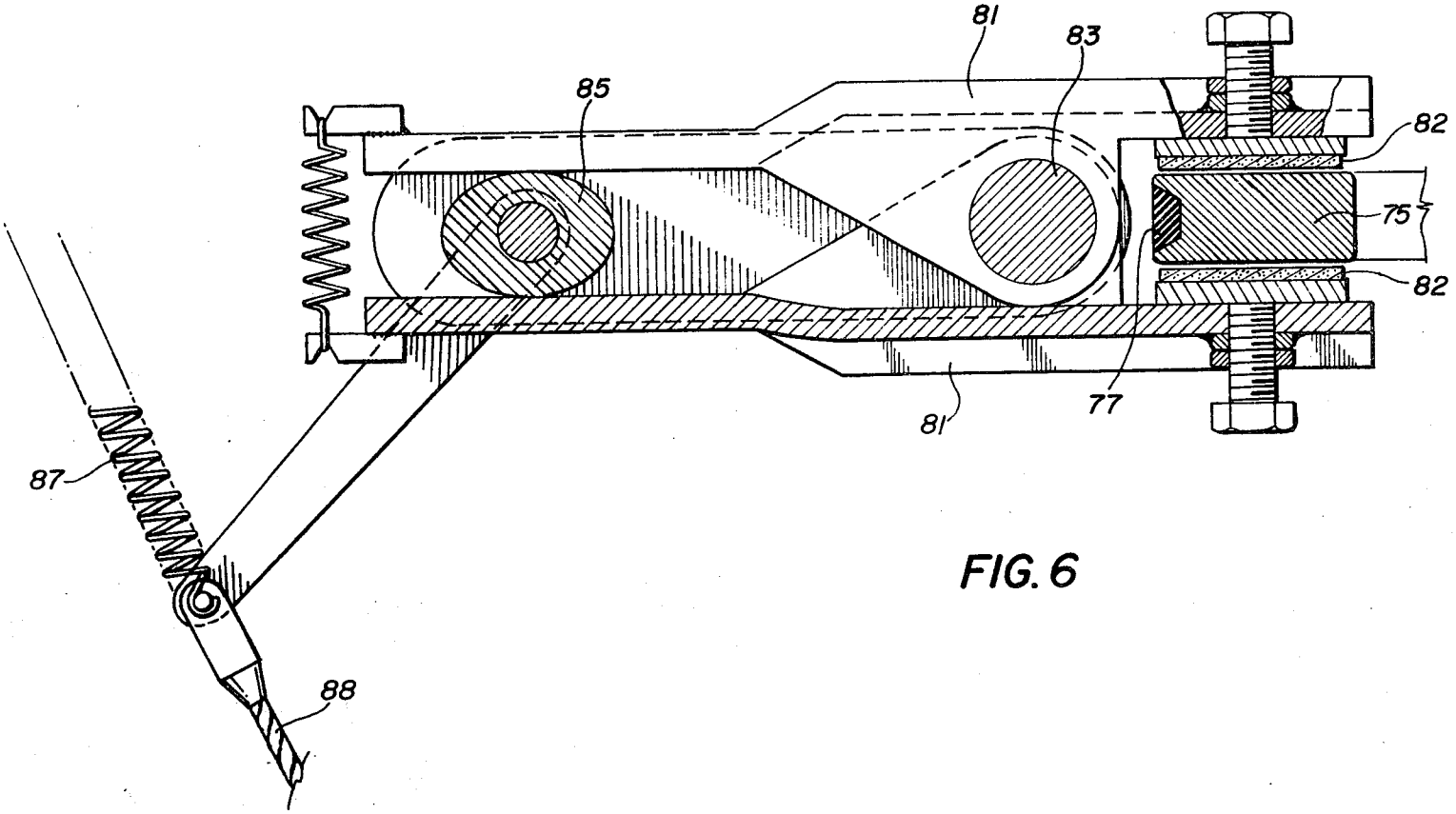
FIG. 6 is a cross-sectional view of a brake mechanism used in the apparatus of FIGS. 1 to 3.

The turntable 14 is driven by a chain 65 (FIG. 2) which engages the teeth 41 and a sprocket 66 rotatably mounted on a shaft 68. The shaft 68 also supports a gear 69 which is connected by a wire mesh belt 70 to a gear 72 on a shaft 73. A pulley 75 on the shaft 73 is connected to a clutch assembly 76 by a belt 77. The clutch assembly 76 is connected to an electric motor 78. A simple brake mechanism 80 (FIGS. 3 and 5) is provided to permit stopping of the turntable 14 at a specific position for the purpose described hereinafter. The brake mechanism 80 includes a pair of jaws 81, with a brake lining 82 on the inner end of each jaw for engaging the pulley 75. The jaws 81 are pivotally mounted on a shaft 83 extending outwardly from an arm 84 of the frame of the apparatus. The jaws are rotated about the shaft 83 by a cam 85 between the outer ends of the jaws. The jaws are normally maintained in the open position by a small spring 86. The cam 85 is biased to a position in which the jaws are open by a spring 87 connected to the frame of the apparatus. A cable 88 passing around pulleys 89, one of which is illustrated, to a foot pedal (not shown) is also connected to the cam 85 for rotating the latter to close the jaws 81 against the bias of the spring 87.

The female die 50 is a block in the form of a rectangular parallelepiped. The block is split, both halves 90 and 91 being slidably mounted on the tracks 44 on the turntable 14. The female die 50 is provided with a cylindrical, profiled cavity 93 defining the specific configuration of a wheel rim to be formed in the apparatus. A recess 94 is provided in each half of the female die 50 at the bottom centre of the profiled cavity 93 for receiving the blank positioner 56, i.e. permitting free sliding movement of the positioner beneath the female die 50.

Figure 7:
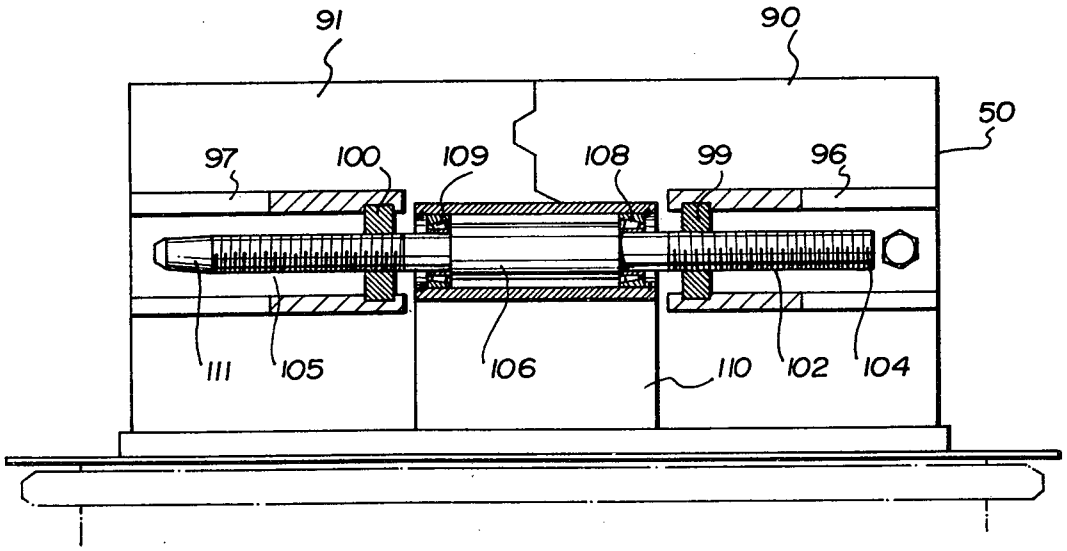
FIG. 7 is a partly sectioned elevation view of the female die of the apparatus of FIGS. 1 and 2.

The halves 90 and 91 of the female die 50 are provided with brackets 96 and 97 extending outwardly from the top side edges thereof. The brackets 96 and 97 include sleeves 99 and 100, respectively supporting a screw 102. The screw 102 (FIG. 7) has threaded ends 104 and 105, the threads on one end being opposite the threads on the other end. In the same manner, the threads in each sleeve 99 are opposite the threads in each of the other sleeves 100. The screw 102 includes a smooth, unthreaded central position 106 rotatably mounted in roller bearings 108 and 109 in blocks 110 extending upwardly from the turntable 14 on each side of the female die 50. Thus, when the screw 102 is rotated in one direction, the die halves 90 and 91 move apart to an open position, and, when the direction of rotation of the screw is reversed, the female die halves 90 and 91 move together to the closed position illustrated in FIG. 5.

The inner end 111 of each screw 102 tapers towards the rear of the apparatus and has a square cross-sectional configuration. In order to rotate the screw 102 for opening or closing the female die 50, the tapered end 111 of each screw is engaged by a socket 112 of square cross-sectional configuration on one end of a shaft 113. The shaft 113 is rotatably mounted in bearings 114 in the rectangular carriage 8, which is slidably mounted on the tracks 6. Each shaft 113 is rotated by an electric motor 115 (FIG. 3) mounted on the carriage 8. The drive shaft 117 of the motor is provided with a pulley 119 connected by a V-belt 120 to a pulley 121 on a central shaft 123 rotatably mounted in bearings 124 in the carriage 8. A double gear 126 is mounted on the shaft 123 for driving gears 127 on the shafts 113. A chain 128 passing around the gears 126 and 127 also passes around one side of a tensioning gear 130 mounted in the carriage 8 between the shafts 113 and 123.

The carriage 8 is advanced to a screw-engaging position and retracted by means of a yoke 132, including arms 133 pivotally connected clevis-fashion to each end of the carriage 8 for rotation about a horizontal axis by pins 134, the outer end 135 of the arms 133 being bifurcated for such purpose. The arms 133 are connected to a central plate 137 which extends rearwardly to a lever 138 and a piston-cylinder arrangement 139 for moving the yoke 132 and carriage 8 forwardly and rearwardly. The lever 138 is pivotally connected at one end to the plate 137 and at the other end to the piston rod 140 of the piston-cylinder arrangement 139, which is pivotally mounted on the beam 12. Two fulcrum arms 141 are pivotally connected to the lever 138 by a pin 142 and to the beam 12 beneath the piston-cylinder arrangement 139. The lever 138 is reinforced by a short arm 143 extending between the plate 137 and the pin 142. Thus, when the piston rod 140 is retracted, the carriage 8 moves rearwardly, the lever 138 rotating about the pin 142, and, when the piston rod 140 is extended, the carriage 8 moves forward, the angle between the lever 138 and fulcrum arms 141 increasing. A limit switch 144 is provided on one of the tracks 6, for engagement by a lug 145 on one sleeve 146, carrying the carriage 8. The switch 144 prevents rotation of the turntable 14 and female die 50 until the carriage 8 and shafts 113 are completely clear of the turntable 14 and the female die 50.

The male die 53 is movably supported above the female die 50 on the lower end of a hydraulic cylinder 147. The cylinder 147 is slidably mounted in a bushing 148 in the cross-bar 5. A piston rod 149 extending upwardly from the top end of the cylinder 147 is connected to the top beam 4. The male die 53 is vertically movable between an upper loading position for permitting loading of the female die 50 with a blank 150 (FIGS. 1 and 9) and a lower rim-forming position.

Figure 8:
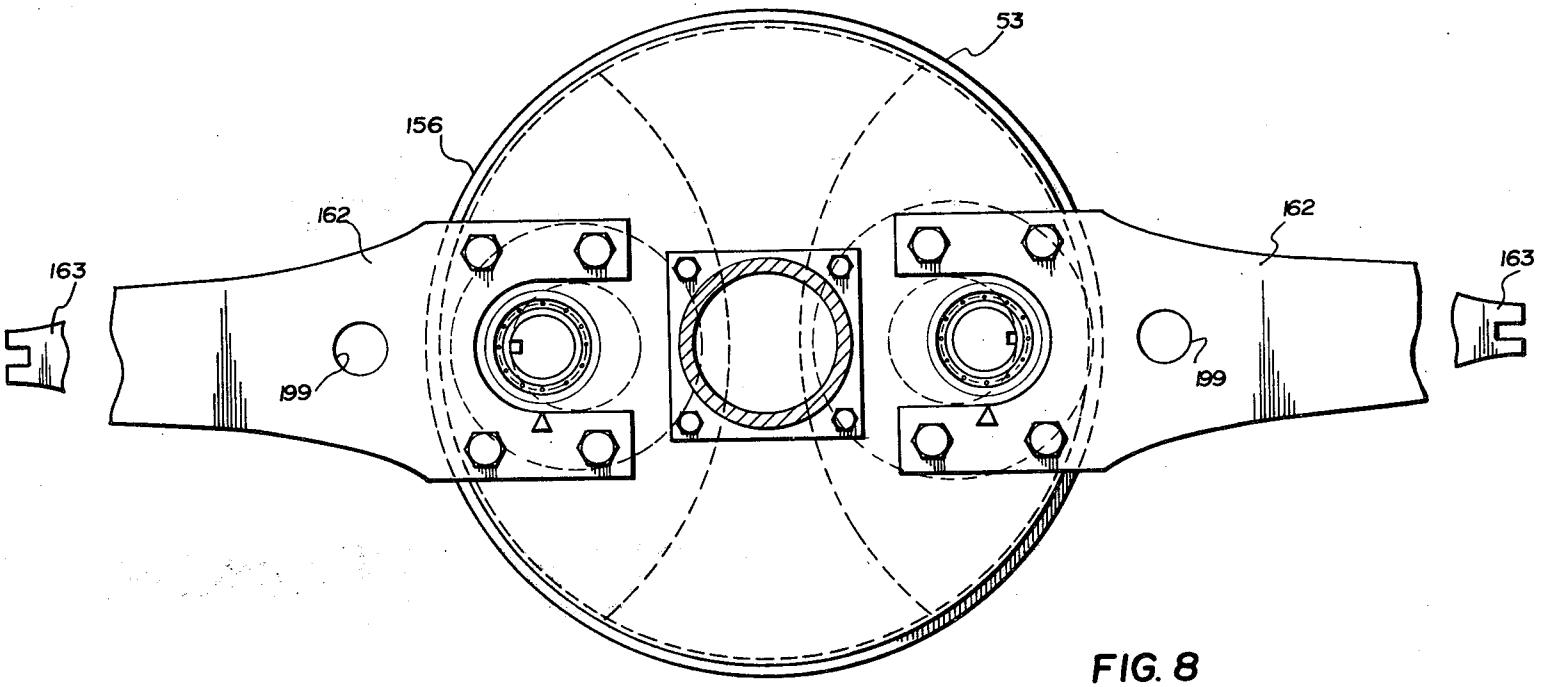
FIG. 8 is a plan view of a male die used in the apparatus of FIGS. 1 and 2.

The male die 53 includes a cage defined by top and bottom plates 152 and 153, respectively, and a post 154 extending therebetween. The post 154 is in the form of a cylinder with two semi-circular grooves removed therefrom. The grooves extend along the entire length of the post 154 on opposite sides thereof. A blank-retaining ring 156 is loosely mounted in a rectangular groove 157 extending around the centre of the outer periphery of the post 154. Roller bearings 159 are provided in an aperture 160 in the bottom plate 153 of the male die 53 for receiving the post 51 on the turntable 14. Thus, the turntable 14 and female die 50 can be rotated while the male die 53 is held stationary. In order to ensure that the male die 53 remains stationary when the turntable 14 and female die 50 are rotated, a pair of arms 162 are provided on the top plate 152 of the male die. The arms 162 extend radially outwardly from opposite sides of the top plate 152, and are provided with slots 163 (FIG. 8) in their outer ends for engaging lugs 164 (FIG. 1) on the columns 2. Thus, when the male die 53 is at its lowermost position in the female die 50, rotation of the arms 162 and consequently the male die 53 is prevented by the lugs 164.

A pair of identical shafts 166 and 167 are rotatably mounted in bearings 169 and 170 in the top and bottom plates 152 and 153, respectively of the male die 53. Each of the shafts 166 and 167 is in the form of a double cam, having large diameter portions 171 and 172 above and below the longitudinal centre of the shaft. The shaft 166 supports a pair of opposed generally frusto-conical rollers 173 and 174 for forming the well portion of a wheel rim, and the shaft 167 supports a pair of rollers 175 and 176 for forming the bead portion of a wheel rim.

For such purpose, the rollers 173 and 174 are generally frusto-conical, and the rollers 175 and 176 are generally frusto-conical with annular convex ridges 178 near the outer ends thereof. All of the rollers are mounted on bearings 180 disposed between the rollers and the large diameter portions of the shaft 166 and 167.

Figure 10:
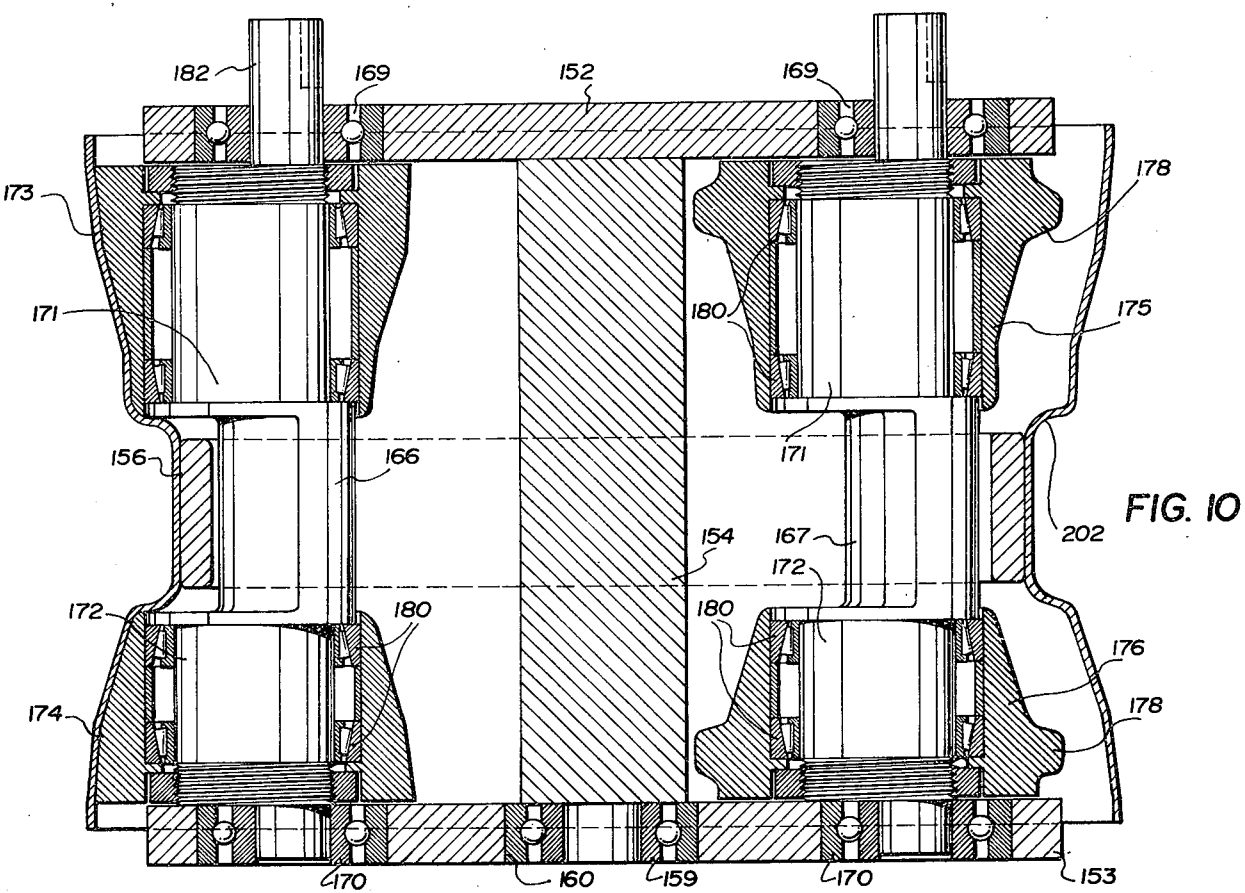
FIG. 10 is a cross-sectional view similar to FIG. 9 of the male die and blank during a rim forming operation.
Figure 11:
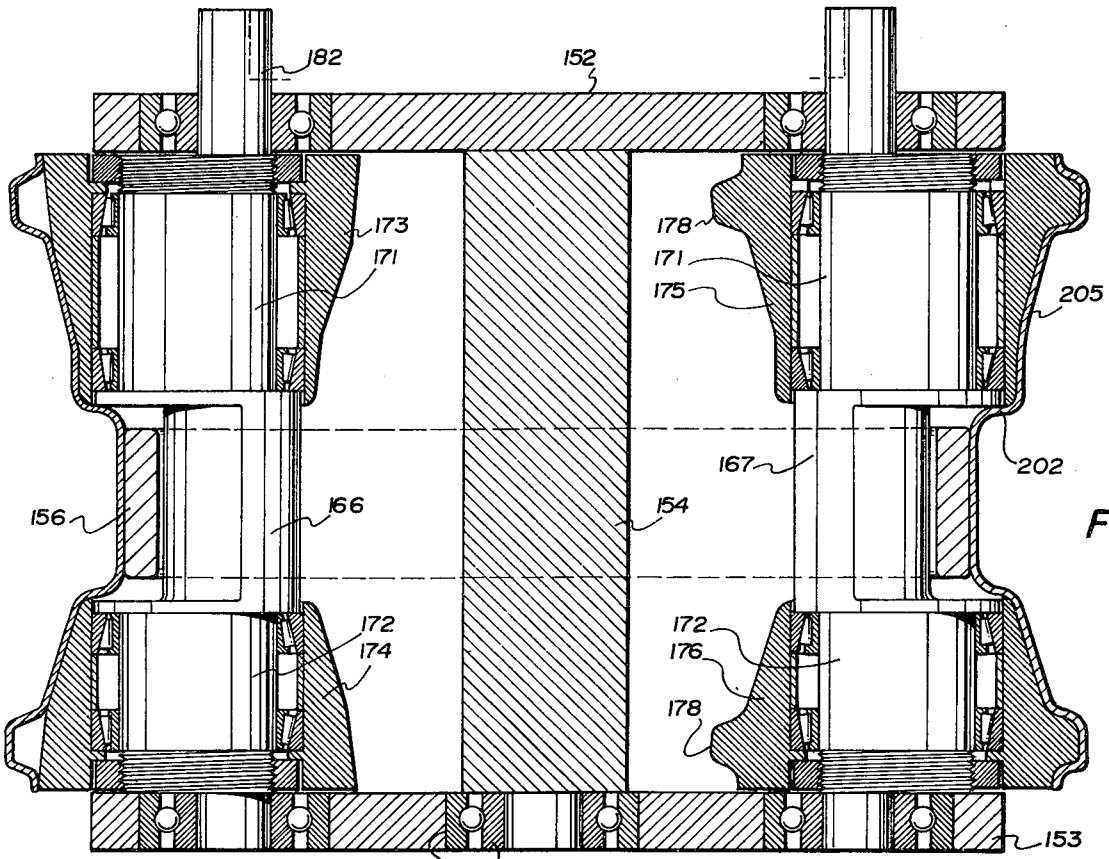
FIG. 11 is a cross-sectional view similar to FIGS. 9 and 10 of the male die and blank at the end of a rim forming operation.
Figure 12:
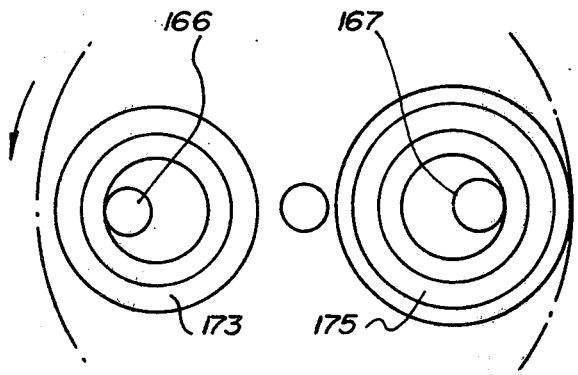
FIGS. 12 to 14 are schematic plan views of rollers in the male die at the start, during and at the end of a rim forming operation.
Figure 13:
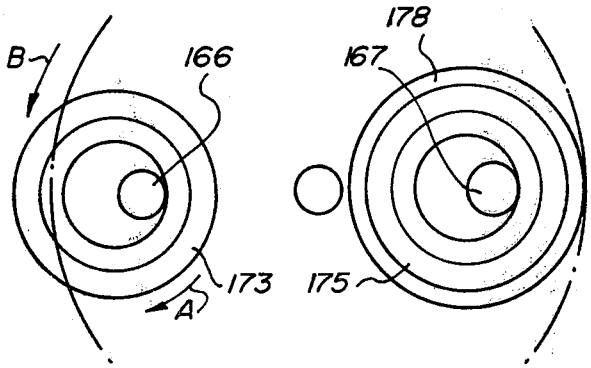
Figure 14:
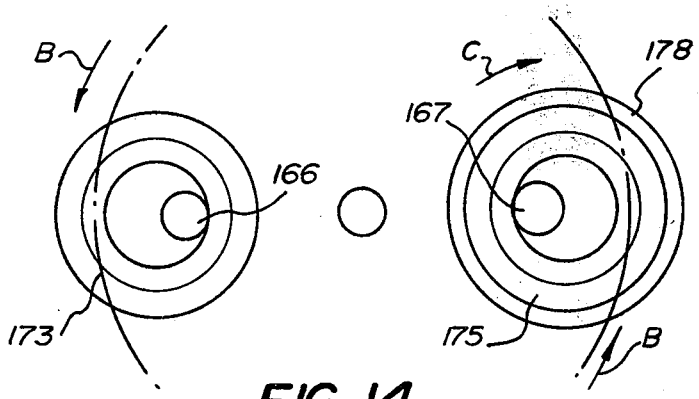

The rollers 173, 174, 175 and 176 are freely rotatable with respect to the shafts 166 and 167, and the shafts are rotatable in the cage defined by the top and bottom plates 152 and 153, respectively, and the post 154. The top end 182 of each of the shafts 166 and 167 mates with a socket 183 on the bottom end of a square cross-section shaft 185. The shaft 185 can be rotated up to 180° to move the rollers 173, 174, 175 and 176 from a retracted position (FIG. 9) in the male die 53 to an extended position (FIGS. 10 and 11) during rim formation. The shafts 185 extend upwardly through the cross-bar 5. A pinion 186 is mounted on each shaft 185 above the cross-bar 5 between a pair of pillow block bearings 187 and 188. The bearings 187 and 188 are mounted on plates 189 welded to the cross-bar 5, the plates being reinforced by triangular brace plates 190. A pair of opposed indicator pins 192 and 193 are provided on the top plate 152 of the male die 53 and the socket 183, respectively, for the purpose described hereinafter.

Figure 9:
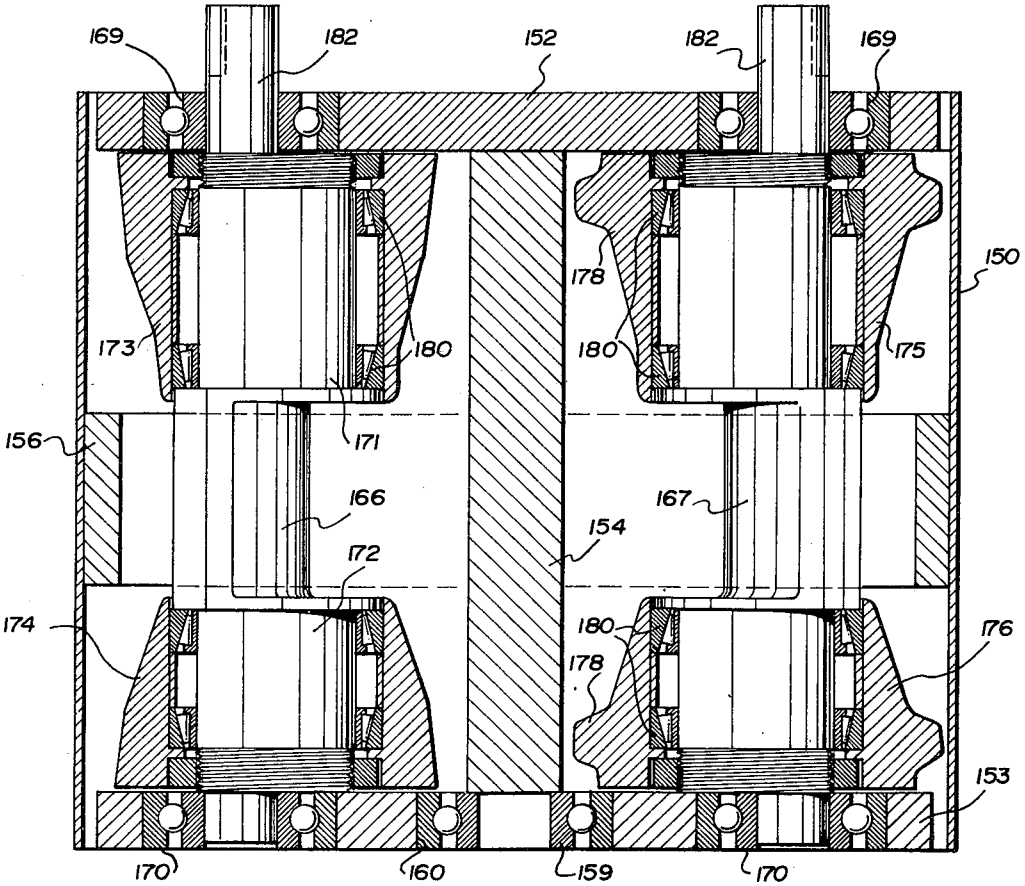
FIG. 9 is a cross-sectional view of the male die and a blank at the start of a rim forming operation.

In order to rotate the shafts 185, a rack 194 engages the pinion 186 on each of the shafts 185. The rack 194 forms the outer end of a piston rod 195 extending into a hydraulic cylinder 196. The cylinder 196 is mounted in a rectangular frame 197 connected to the reinforcing beam 12, and to the cross-bar 5. With the above-described arrangement, the square shafts 185 can be rotated and moved vertically, while the rack 186 and pinion 194 arrangement remains stationary, i.e. does not move vertically. A rim dislodging rod 198 extends downwardly from the cross-bar 5 on each side of the shafts 185 through a hole 199 in the arms 162 (FIGS. 1 and 9).

The operation of the apparatus of the present invention will now be described with particular reference to FIGS. 9 to 14. With the female die 50 open, i.e. with the die halves 90 and 91 spaced apart on the turntable 14, a cylindrical blank 150 is placed in the female die 50, with the longitudinal axis of the blank parallel to that of the female die 50. By actuating the cylinder 147, the male die 53 is moved downwardly into the blank 150, which is manually positioned beneath the male die 53. The male die 53 is advanced into the blank 150 a distance sufficient for the blank to be engaged internally by the ring. The external diameter of the ring 156 of the male die 53 is approximately the same as the internal diameter of the blank 150, so that there is a friction fit of the blank on such ring. The male die 53 is then moved out of the female die 50 with the blank 150 to a position where the blank is clear of the female die. The blank positioners 56 are moved to their innermost positions, and the male die 53 is moved downwardly to its lowermost position. As the male die 53 moves downwardly, the blank 150 is forced upwardly by the blank positioners 56. When the male die 53 reaches its lowermost position, the blank 150 is properly positioned for formation of a wheel rim.

The piston-cylinder arrangement 139 is actuated to move the carriage 8 forward, so that the tapered end 111 of each screw 102 is engaged by a socket 112. The motor 115 is started to rotate the screws 102, closing the female die 50. The carriage 8 is moved away from the female die 50 and screws 102 along the tracks 6 until the lug 145 closes the switch 144. Until the switch 144 closes, the turntable 14 and female die 50 cannot rotate; otherwise the screws 102 and possibly associated drive elements would be severly damaged if not destroyed by the massive female die 50. Upon closing of the switch 144, the motor 78 is started to rotate the turntable 14 and the female die 50.

With the female die 50 closed, the blank 150 is sandwiched between the ring 156 and a central, smallest diameter portion 200 of the female die cavity (FIG. 1). By actuating one of the cylinders 196, the shaft 166 is slowly rotated approximately one half revolution to bring the rollers 173 and 174 to bear against the blank 150. As the rollers 173 and 174 move outwardly, the portion of the blank 150 on each side of the centre is gradually deformed to form the well portion 202 of a wheel rim. The shaft 166 and consequently the rollers 173 and 174 are rotated outwardly against the blank 150 in a direction A (FIG. 12) opposite to the direction B of rotation of the turntable 14 and female die 50. When the rollers 173 and 174 reach their outermost positions, formation of the well portion 202 of the wheel rim is complete.

The pins 192 and 193 on the top plate 152 and socket 183, respectively are initially unaligned. When the rollers 173 and 174 or 175 and 176 reach their outermost positions, the pins 192 and 193 are aligned, providing the operator with an indication that the rim formation function of such rollers has been completed, i.e. that the rollers are fully extended.

By actuating the other cylinder 196, the shaft 167 is slowly rotated approximately one-half revolution in a direction C opposite to the direction B of rotation of the female die to bring the rollers 175 and 176 to bear against the partially formed blank 150. When the rollers 175 and 176 reach their outermost positions, a wheel rim 205 is completely formed. During outward movement of the rollers 175 and 176, the rollers 173 and 174 are maintained in their outermost positions (FIGS. 10 to 14).

Thus, it is readily apparent that throughout the formation process, the blank 150 is held in position by the ring 156 and the smallest diameter portion 200 of the female die 50. The formation of the rim 205 does not result in changes in the thickness of the blank 150. During rim formation the ends of the blank 150 are drawn into the female die cavity. As mentioned hereinbefore, it has been found that a 12 inch long blank of ¼ inch steel results in a 10 inch long rim having a thickness throughout its length of ¼ inch.

As soon as rim formation has been completed, the rollers 173, 174, 175 and 176 are retracted and the motor 78 is stopped to cause the turntable 14 to slow down. By operating the brake mechanism, the operator can stop the turntable 14 at a position where the sockets 112 are approximately aligned with the tapered ends 111 of the screws 102. Because both the ends 111 of the screws 102 and the sockets 112 are tapered, exact alignment is not required. The piston-cylinder arrangement 139 is again actuated to move the carriage 8 forward, so that the sockets 112 engage the tapered ends 111 of the screws 102, and the motor 115 is started to rotate the screws 102, opening the female die 50. Then, the cylinder 147 is actuated to raise the male die 53 with the wheel rim 205 held on the ring 156. As the male die 53 rises, the top edge of the rim 205 engages the rim dislodging rods 198, so that continued upward movement of the male die 53 results in removal of the rim 205 from the male die.

The apparatus is then ready for the start of a new rim formation.

We claim:

1. An apparatus for forming a wheel rim from a cylindrical blank comprising a rotatable turntable; first drive means for rotating said turntable; a female die mounted on said turntable for rotation therewith, said female die having a generally cylindrical, profiled cavity for receiving a cylindrical blank; second drive means for opening and closing said female die; a male die including at least two separate roller shafts and rollers mounted on each roller shaft; third drive means for inserting the male die into the blank in the female die; and fourth drive means for moving each roller shaft individually towards and away from the blank and female die, whereby when the blank and female die are rotating, the blank is deformed sequentially against the female die cavity to form a wheel rim.

2. The apparatus according to claim 1, wherein said female die includes a split block having two identical halves each containing one half of said die cavity; said turntable including track means slidably supporting said female die halves, said second drive means moving said female die halves relative to each other for opening and closing said female die.

3. The apparatus according to claim 2, including positioning means on said turntable for accurately positioning a blank on said male die in the female die to ensure accurate rim formation.

4. The apparatus according to claim 2, including screw means engaging each of said female die halves, said second drive means including motor means for engaging and operating said screw means for opening and closing the female die.

5. The apparatus according to claim 4, including means for moving said second drive means into and out of engagement with said screw means; and switch means for actuation by said second drive means for preventing rotation of the turntable and female die until the second drive means is out of engagement with said screw means.

6. The apparatus according to claim 1, wherein said male die is substantially cylindrical and includes a ring rotatable with the female die while the remainder of the male die remains stationary, said ring having a diameter substantially equal to the internal diameter of a blank for retaining the blank in a fixed position in the female die during rim formation, the ring being located centrally of the blank during rim formation.

7. The apparatus according to claim 6, wherein said male die includes circular top and bottom plates, post means extending between said plates; said roller shafts being rotatably mounted in said top and bottom plates, and including eccentric portions rotatably supporting said rim forming rollers, said fourth drive means rotating said roller shafts between a rest position in which the rollers are completely within the substantially cylindrical male die and a rim position in which the rollers are outside the periphery of the male die.

8. The apparatus according to claim 7, wherein said fourth drive means includes a drive shaft connected to each said roller shaft; and means for rotating said drive shaft by up to 180°, whereby the roller shafts are rotated between the rest and rim forming positions.

9. The apparatus according to claim 8, wherein said drive shaft has a square cross-sectional configuration, the means for rotating the drive shaft including a pinion mounted on the shaft, a rack in constant engagement with said pinion, and a cylinder for reciprocating said rack.

10. The apparatus according to claim 2, including screw means engaging each of said female die halves; a frame supporting said turntable, and male and female dies; said second drive means including tracks on said frame, a carriage slidable on said tracks, shaft means rotatably mounted in said frame for engaging and rotating said screw means, a motor and transmission means connecting said motor to said shaft means; and means for moving said carriage between a position in which the shaft means engages said screw means and a position in which the shaft means is remote from said screw means.

* * * * *